US008385581B2

(12) United States Patent
Li et al.

(10) Patent No.: US 8,385,581 B2
(45) Date of Patent: Feb. 26, 2013

(54) SPEAKER WITH DUAL MAGNETIC CIRCUITS

(75) Inventors: Lin-Zhen Li, Shenzhen (CN); Qun Xiang, Shenzhen (CN)

(73) Assignees: AAC Acoustic Technologies (Shenzhen) Co., Ltd., Shenzhen (CN); AAC Technologies PTE. Ltd, Singapore (SG)

( * ) Notice: Subject to any disclaimer, the term of this patent is extended or adjusted under 35 U.S.C. 154(b) by 171 days.

(21) Appl. No.: 12/978,593

(22) Filed: Dec. 26, 2010

(65) Prior Publication Data

US 2011/0170736 A1 Jul. 14, 2011

(30) Foreign Application Priority Data

Jan. 11, 2010 (CN) ..... 2010 2 0056357 U

(51) Int. Cl.
*H04R 1/00* (2006.01)

(52) U.S. Cl. ..... 381/401; 381/421

(58) Field of Classification Search ..... 381/412, 381/420, 421, 396, 400–407
See application file for complete search history.

(56) References Cited

U.S. PATENT DOCUMENTS 6,754,363 B2 * 6/2004 Chang ..... 381/401

* cited by examiner

*Primary Examiner* — Curtis Kuntz
*Assistant Examiner* — Sunita Joshi
(74) *Attorney, Agent, or Firm* — IPro, Inc.; Na Xu

(57) ABSTRACT

A speaker includes a case, a dome, a diaphragm, a first voice coil, a second voice coil, a first pole plate, a second pole plate, a first magnet, a second magnet and a yoke. The case is supported on the frame to form a receiving room therebetween. The yoke includes a bottom portion and a side portion perpendicularly extending upward from the center of the bottom portion. A first magnetic gap is formed between the inner wall of the side portion and the outer wall of the magnet for receiving the first voice coil, and a second magnetic gap is formed between the outer wall of the side portion and the inner wall of the second magnet for receiving the second voice coil.

13 Claims, 2 Drawing Sheets

SPEAKER WITH DUAL MAGNETIC CIRCUITS

BACKGROUND OF THE INVENTION

1. Field of the Invention

The present disclosure relates to the art of speakers and, particularly to a speaker with dual magnetic circuits for converting electrical signals including audio information to audible sounds.

2. Description of Related Art

With the rapid development of technologies, the design of electronic devices, such as cellular phones, PDAs (personal digital assistants), and so on, is being driven by the marketplace towards providing more and more multimedia functions. At the same time, consumer's demand has continued to push a dramatic reduction in the size of the electronic devices.

To comply with the multimedia requirements and reduce the size of the electronic devices, most electronic devices today include a micro-speaker. Quality of the sound from the micro-speakers strongly influences customer's buying decisions. A micro-speaker related to the present disclosure includes a case defining a sound hole, a frame attached to the case for forming a chamber, a magnetic circuit defining a magnetic gap, a diaphragm located in the chamber, and a voice coil attached to the diaphragm. While electrified, the voice coil will be activated to vibrate by the Lorenz Force and further drives the diaphragm to vibrate, which converts the electrical signals to sound waves. The diaphragm needs sufficient space to vibrate for ensuring good acoustic performance. However, as the trend of the volume of the micro-speaker is smaller and smaller, space provided for the diaphragm to vibrate is accordingly reduced and limited.

Therefore, it is desirable to provide a speaker with dual magnetic circuits which can overcome the above-mentioned problems.

BRIEF DESCRIPTION OF THE DRAWINGS

Many aspects of the embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
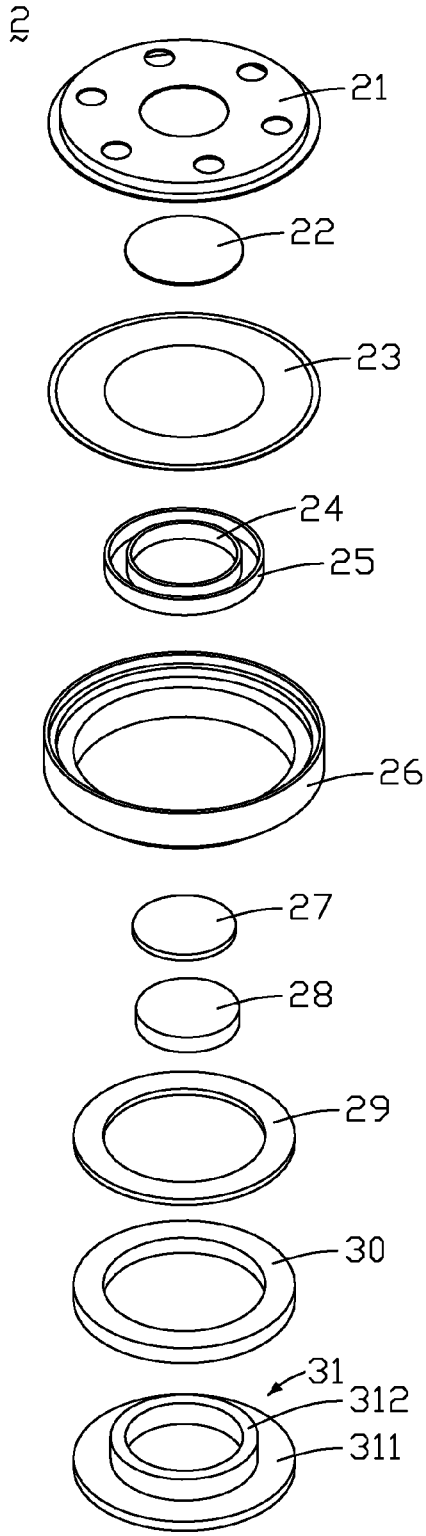
FIG. 1 is an exploded, isometric view of a speaker with dual magnetic circuits according to an exemplary embodiment.
Figure 2:
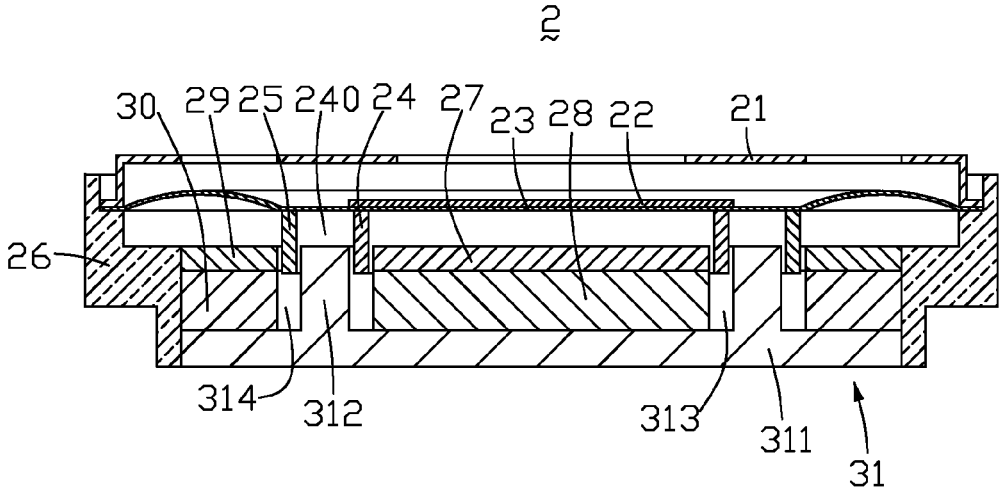
FIG. 2 is a schematic cross-sectional view of the speaker with dual magnetic circuits of FIG. 1.

Referring to FIGS. 1 and 2, a speaker 2 with dual magnetic circuits, according to an exemplary embodiment, includes a case 21, a dome 22, a diaphragm 23, a first voice coil 24, a second voice coil 25, a frame 26, a first pole plate 27, a first magnet 28, a second pole plate 29, a second magnet 30 and a yoke 31. The case 21 is supported on the frame 26 to form a receiving room (not labeled) therebetween. A combination of the case 21 and the frame 26 is named as a supporting device of the speaker 2. The dome 22, the diaphragm 23, the first and second voice coils 24, 25, the first and second pole plates 27, 29, the first and second magnets 28, 30 and the yoke 31 all are received in the receiving room and embedded within the supporting device to form an integral unit.

The diaphragm 23 defines an upper surface (not labeled) and a bottom surface opposite to the upper surface. The dome 22 is adhered on the center of the upper surface of the diaphragm 23. The diaphragm 23 is made from tractile and soft material. The dome 22 and the diaphragm 23 cooperatively form a vibration system for producing sound via vibrating. Be noted that the dome 22 is used to enhance the vibration of the diaphragm 23 for improving the quality of the sounds. Without the dome 22, the speaker 2 can still work normally.

The first and second voice coils 24 an 25 are columned configuration and wound spiral of two or more turns of metal wire, such as copper wire. The first and second voice coils 24 and 25 are fixed to the bottom surface of the diaphragm 23. An outer diameter of the first voice coil 24 is smaller than that of the second voice coil 25. A space 240 is formed between an outer wall of the first voice coil 24 and an inner wall of the second voice coil 25.

The first pole plate 27 and the first magnet 28 are columned configuration. An outer diameter of the first pole plate 27 is not smaller than that of the first magnet 28. The first pole plate 27 covers a top surface of the first magnet 28. In the same way, the second pole plate 29 and the second magnet 30 also are columned configuration and each defines a through hole (not labeled) in the center thereof. The outer diameter of the second pole plate 29 is also not smaller than that of the second magnet 30, thereby the second pole plate 29 is disposed on a top surface of the second magnet 30. The first and second magnets 28, 30 are permanent magnets. The assembly of the first pole plate 27 and the first magnet 28 is passed through the through holes of the second pole plate 29 and the second magnet 30 and received in the receiving room, thereby the first pole plate 27 and the first magnet 28 are coaxially surrounded by the second pole plate 29 and the second magnet 30.

The yoke 31 includes a bottom portion 311 and a side portion 312 perpendicularly extending upwardly from a center of the bottom portion 311. The bottom portion 311 is a circular plate, and the side portion 312 is an annular configuration. A groove (not labeled) is defined in the center of the side portion 312. The outer diameter of the bottom portion 311 is greater than that of the side portion 312, thereby a sidestep (not labeled) is formed on the periphery of the bottom portion 311 and around the side portion 312. The assembly of the second pole plate 29 and the second magnet 30 is mounted on the sidestep of the bottom portion 311. It's optional that the outer diameter of the second magnet 30 is same as that the bottom portion 311. The first pole plate 27 and the first magnet 28 are received in the groove of the side portion 312. The inner diameter of the groove of the side portion 312 is greater than the outer diameter of the first pole plate 27 and the first magnet 28, thereby a first magnetic gap 313 is formed between the outer wall of the assembly of the first pole plate 27 and the first magnet 28 and the inner wall of the side portion 312. Meanwhile, the first voice coil 24 is partially inserted into the first magnetic gap 313 to surround the first pole plate 27 and the first magnet 28.

The side portion 312 of the yoke 31 is received in the space 240 between the first voice coil 24 and the second voice coil 25. The inner diameter of the through holes of the second pole plate 29 and the second magnet 30 is greater than the outer diameter of the side portion 312, thereby a second magnetic gap 314 is formed between the outer wall of the side portion 312 and the inner wall of the through hole of the second magnet 30. Meanwhile, the second voice coil 25 is partially inserted into the second magnetic gap 314 to surround the second pole plate 29 and the second magnet 30.

In additional, in the present embodiment, it's optional that the magnetization direction of the first magnet 28 is adverse from the second magnet 30. Such as the magnetization direction of the first magnet 28 is formed upwardly, that of the second magnet 30 is formed downwardly. Since other types of arrangement of the magnetization directions of the first and second magnets 28 and 30 are feasible in this disclosure, the scope of this disclosure is not limited by the above mentioned.

With the configuration mentioned above, a speaker with dual magnetic circuits is obtained.

When an electric current is respectively applied to the first and second voice coils 24 and 25, two magnetic field loops are produced in the corresponding magnetic circuits, the first and second voice coils 24 and 25 are respectively activated to move by Lorenz Force, and accordingly, the diaphragm 23 is driven to vibrate by the first and second voice coils 24 and 25, which produces sound waves.

It will be understood that the above particular embodiment is shown and described by way of illustration only. The principles and the features of the present disclosure may be employed in various and numerous embodiments thereof without departing from the scope of the disclosure as claimed. The above-described embodiment illustrates the scope of the disclosure but do not restrict the scope of the disclosure.

What is claimed is:

1. A speaker with dual magnetic circuits comprising:

a frame defining a receiving room therein;

a yoke received in the receiving room and defining a side portion thereon;

a diaphragm received in the receiving room;

a first vibration system, having a first voice coil, a first pole plate, and a first magnet;

a second vibration system, having a second voice coil, a second pole plate, and a second magnet;

the first and second voice coils, the first and second pole plates, the first and second magnets all received in the receiving room below the diaphragm, the side portion surrounding the first voice coil and the first voice coil surrounding the first magnet, the second magnet surrounding the second voice coil and the second voice coil surrounding the side portion; wherein a first magnetic gap is formed between an inner wall of the side portion and an outer wall of the first magnet and configured to receive the first voice coil, and a second magnetic gap is formed between an outer wall of the side portion and an inner wall of the second magnet and configured to receive the second voice coil; and wherein the first and second voice coils are fixed to the bottom surface of the diaphragm, and the outer diameter of the first voice coil is smaller than that of the second voice coil to coaxially be surrounded by the second voice coil, thereby a space is formed between the outer wall of the first voice coil and the inner wall of the second voice coil for receiving the side portion of the yoke therein.

2. The speaker as claimed in claim 1, wherein the yoke further comprises a bottom portion from which the side portion perpendicularly extends upwardly and a sidestep is formed on the periphery of the bottom portion around the side portion, and the first and second magnets locate on the bottom portion.

3. The speaker as claimed in claim 1 further comprising a case being supported on the frame and forming the receiving room together with the frame.

4. The speaker as claimed in claim 2, wherein a groove is defined in the center of the side portion for positioning the first magnet therein, and the groove opens upon the diaphragm.

5. The speaker as claimed in claim 1, wherein the first pole plate and the first magnet are columned configuration and the outer diameter of the first pole plate is not smaller than that of the first magnet, and the first pole plate wraps on the first magnet.

6. The speaker as claimed in claim 1, wherein the second pole plate and the second magnet are columned configuration and the outer diameter of the second pole plate is not smaller than that of the second magnet, and the second pole plate is wrapped on the second magnet.

7. The speaker as claimed in claim 6, wherein the assembly of the second pole plate and the second magnet is positioned on the sidestep of the bottom portion.

8. The speaker as claimed in 1 further comprising a dome being adhered on the center of the upper surface of the diaphragm.

9. The speaker as claimed in claim 1, wherein the magnetization direction of the first magnet is adverse from that of the second magnet.

10. A speaker with dual magnetic circuits comprising:

a frame;

a case attached to the frame and cooperative with the frame for defining a receiving room therein;

a yoke received in the receiving room and defining a side portion thereon;

a diaphragm positioned below the case and received in the receiving room;

a first vibration system received in the receiving room and having a first voice coil with an end connected to the bottom of the diaphragm, a first magnet, a first pole plate wrapped on the first magnet;

a second vibration system received in the receiving room and having a second voice coil with an end connected to the bottom of the diaphragm and coaxial with the first voice coil, a second magnet, a second pole plate wrapped on the second magnet;

the outer diameter of the first magnet smaller than the inner diameter of the side portion to form a first magnetic gap therebetween for receiving an opposite end of the first voice coil;

the outer diameter of the side portion smaller than the inner diameter of the second magnet to form a second magnetic gap therebetween for receiving an opposite end of the second voice coil.

11. The speaker as claimed in claim 10, wherein the yoke further comprises a bottom portion, and the side portion extends upwardly from the center of the bottom portion, thereby a sidestep is formed on the periphery of the bottom portion around the side portion, and the first and second magnets locate on the bottom portion.

12. The speaker as claimed in claim 11, wherein the side portion defines a groove in the center thereof, and the assembly of the first pole plate and the first magnet is positioned in the groove and surrounded by the first voice coil, and the groove opens upon the diaphragm.

13. The speaker as claimed in claim 11, wherein the second pole plate wrapped on the top surface of the second magnet, and the assembly of the second plate and the second magnet is positioned on the sidestep and surrounded by the second voice coil.

* * * * *